US010800996B2

(12) United States Patent
Linder et al.

(10) Patent No.: US 10,800,996 B2
(45) Date of Patent: Oct. 13, 2020

(54) HIGH FOAMING LIQUID ALKALINE CLEANER CONCENTRATE COMPOSITION

(71) Applicant: AMERICAN STERILIZER COMPANY, Mentor, OH (US)

(72) Inventors: Jessica Sue Haney Boester Linder, Belleville, IL (US); Ping Xia, St. Louis, MO (US); Nancy-Hope Elizabeth Kaiser, Collinsville, IL (US)

(73) Assignee: American Sterilizer Company, Mentor, OH (US)

( * ) Notice: Subject to any disclaimer, the term of this patent is extended or adjusted under 35 U.S.C. 154(b) by 17 days.

(21) Appl. No.: 16/272,282

(22) Filed: Feb. 11, 2019

(65) Prior Publication Data

US 2020/0255767 A1 Aug. 13, 2020

(51) Int. Cl.

| | |
|---|---|
| ***C11D 1/83*** | (2006.01) |
| ***C11D 3/00*** | (2006.01) |
| ***C11D 3/04*** | (2006.01) |
| ***C11D 3/10*** | (2006.01) |
| ***C11D 3/30*** | (2006.01) |
| ***C11D 1/22*** | (2006.01) |
| ***C11D 3/33*** | (2006.01) |
| ***C11D 3/12*** | (2006.01) |
| ***C11D 1/75*** | (2006.01) |
| *C11D 11/00* | (2006.01) |

(52) U.S. Cl.

CPC ..... *C11D 3/0094* (2013.01); *C11D 1/22* (2013.01); *C11D 1/75* (2013.01); *C11D 3/0073* (2013.01); *C11D 3/044* (2013.01); *C11D 3/10* (2013.01); *C11D 3/1246* (2013.01); *C11D 3/30* (2013.01); *C11D 3/33* (2013.01); *C11D 11/0029* (2013.01)

(58) Field of Classification Search

CPC ..... C11D 1/83; C11D 3/1246; C11D 1/722; C11D 3/22; C11D 3/33; C11D 3/3418; C11D 7/14; C11D 7/3263; C11D 7/5004; C11D 9/12; C11D 11/0023

See application file for complete search history.

(56) References Cited

U.S. PATENT DOCUMENTS

| | | | | |
|---|---|---|---|---|
| 2,479,694 | A | 8/1949 | Morey et al. | |
| 4,280,560 | A | 7/1981 | Sydansk | |
| 5,368,779 | A | 11/1994 | Snethen | |
| 5,853,490 | A * | 12/1998 | Dunn | C23G 1/00 134/2 |
| 5,929,011 | A | 7/1999 | Scepanski | |
| 5,981,457 | A | 11/1999 | Ahmed | |
| 6,586,529 | B2 | 7/2003 | Mumick et al. | |
| 7,795,000 | B2 | 9/2010 | Podtburg et al. | |
| 7,838,485 | B2 * | 11/2010 | Heisig | C11D 3/225 510/225 |
| 7,902,137 | B2 | 3/2011 | Kneipp et al. | |
| 8,329,630 | B2 | 12/2012 | Finison et al. | |
| 8,426,349 | B2 | 4/2013 | Monken | |
| 2007/0207940 | A1 | 9/2007 | Fenyvesi et al. | |
| 2008/0015133 | A1 * | 1/2008 | Rigley | C11D 3/044 510/215 |
| 2009/0298738 | A1 * | 12/2009 | Kneipp | C11D 7/3245 510/245 |
| 2011/0180100 | A1 | 7/2011 | Hafer et al. | |
| 2011/0180619 | A1 | 7/2011 | Konishi et al. | |
| 2011/0230380 | A1 * | 9/2011 | Holzhauer | C11D 3/2075 510/159 |
| 2017/0022458 | A1 * | 1/2017 | Trujillo | C11B 9/0015 |
| 2017/0362498 | A1 | 12/2017 | Jackson et al. | |
| 2018/0010080 | A1 | 1/2018 | Kang et al. | |
| 2018/0086929 | A1 | 3/2018 | Hayashi et al. | |
| 2018/0104166 | A1 | 4/2018 | Lipinski et al. | |
| 2018/0311135 | A1 | 11/2018 | Chang et al. | |
| 2018/0320110 | A1 * | 11/2018 | Dotzauer | C11D 1/835 |
| 2019/0177657 | A1 * | 6/2019 | Man | C11D 1/90 |
| 2019/0291146 | A1 * | 9/2019 | Hodge | B08B 3/003 |

FOREIGN PATENT DOCUMENTS

| | | | |
|---|---|---|---|
| CN | 104010510 | A | 8/2014 |
| CN | 105754745 | A | 7/2016 |
| CN | 106350273 | A | 1/2017 |
| CN | 106675831 | A | 5/2017 |
| CN | 108084890 | A | 5/2018 |

(Continued)

OTHER PUBLICATIONS

'Chelant Science', aboutcleaningproducts.com, 1987, [retrieved from the internet on Mar. 31, 2020 (Mar. 31, 2020) at <https://www.aboutcleaningproducts.com/science/chelant-science/>] para 1.

(Continued)

*Primary Examiner* — Charles I Boyer

(74) *Attorney, Agent, or Firm* — Hudak, Shunk & Farine Co. LPA

(57) ABSTRACT

A high foaming liquid alkaline cleaner comprises one or more alkalinity sources; one or more surfactants comprising a hydrotrope, one or more wetting and soil emulsifying surfactants, one or more foam volume generating surfactants, and one or more foam boosting surfactants and one or more sequestrants. Optionally, an organic solvent can be utilized. The high foaming liquid alkaline cleaning composition is generally prepared in a concentrated form and can be diluted as with water. The alkaline cleaner provides effective cleaning properties, with respect to fats, oils, and organic soils.

10 Claims, 2 Drawing Sheets

(56) References Cited

FOREIGN PATENT DOCUMENTS

WO 9859027 A1 12/1998

OTHER PUBLICATIONS

'Tetrasodium EDTA', Wikipedia, 2016 [retrieved from the Internet on Apr. 6, 2020 (Apr. 6, 2020) at <https://en.wikipedia.org/wiki/Tetrasodium_EDTA> para 2.
'Sodium laureth sulfate', Wikipedia, 1983 [retrieved from the internet on Apr. 1, 2020 (Apr. 1, 2020) at <https://en.wikipedia.org/wiki/Sodium_laureth_sulfate>].
'Examining Tomorrow's Surtactant Personalities: Alpha Olefin Sultonate in Personal Care', cosmeticsandtoiletries.com, Jan. 8, 2018 (Jan. 8, 2018) [retrieved from the internet on Mar. 31, 2020 (Mar. 31, 2020) at <https://www.cosmeticsandtoiletiries.com/formulating/function/surfactant/Examining-Tomorrows-Surfactant-Personalities-Alpha-Olefin-Sulfonate-in-Personal-Care-468347883.html>] para 2.
'Potassium silicate', Wikipedia, 2005 [retrieved from the internet on Mar. 31, 2020 (Mar. 31, 2020) at <https://en.wikipedia.org/wiki/Potassium_silicate>{ p. 2 para 4.
'Potassium hydroxide', Wikipedia, 2005 [retrieved from the Internet on Apr. 1, 2020 (Apr. 1, 2020) al <https://en.wikipedia.org/wiki/Potassium_hydroxide>) para 2.
International Search Report for corresponding PCT Application PCT/US2020/015782 dated Jun. 9, 2020.

* cited by examiner

HIGH FOAMING LIQUID ALKALINE CLEANER CONCENTRATE COMPOSITION

FIELD OF THE INVENTION

A high foaming liquid alkaline cleaner comprises one or more alkalinity sources, one or more surfactants comprising a hydrotrope, one or more soil emulsifying surfactants, one or more foam volume generating surfactants, one or more foam boosting surfactants, and one or more sequestrants having foam stabilizing properties. The liquid alkaline cleaning composition is generally prepared in a concentrated form and, of course, can be diluted as with water.

BACKGROUND OF THE INVENTION

With the advent of ever-increasing environmental concerns as with respect to various cleaning compositions, there is a need to provide effective and efficient alkaline cleaners that are typically used in various manufacturing facilities for cosmetics and drugs, including biotechnology and oral solid dose, and the like. Various prior suitable cleaning compositions, due to new environmental and Drug and Medical device regulations, can no longer be utilized. Moreover, while increased active alkali content is generally associated with improved cleaning performance, use of highly alkaline compositions has been limited due to the pH instability of various components included in the compositions in order to enhance their properties. In particular, certain oxidants, surfactants, hydrotropes, foaming agents and the like are difficult to incorporate into a highly alkaline composition, and the final product generally is not stable in storage for a reasonable shelf life. As a result, an optimal cleaning composition, comprising components necessary to remove "hard-to-clean" soils effectively, has been difficult to achieve. Further, dilution of concentrated, highly alkaline cleaning compositions often results in less than optimal cleaning performance and poor compatibility profiles.

U.S. Pat. No. 7,838,485 relates to an aqueous, alkaline cleaning composition for use on hard-to-clean soils, encountered in pharmaceutical, personal care, food and cosmetic manufacturing, comprising a source of alkalinity, a biodegradable-surfactant system further comprising one or more surfactants, one or more hydrotropes, and a UV-analyzable surfactant, and a biodegradable-chelating agent. The composition supposedly has advantages of stability over the expected shelf life, low-foaming property, phosphate-free and biodegradable components, and unexpectedly enhanced antimicrobial, including virucidal, activity in one cleaning composition. The UV-analyzable surfactant generally allows for validation of cleaning processes using known techniques for manufacturers who are required or desire to do so.

U.S. Pat. No. 7,902,137, relates to an alkaline concentrated detergent composition for use in cleaning hard surfaces, medical instruments and other metal components (parts, tools, utensils, vessels, equipment) supposedly having superior cleaning efficacy at much lower alkali content than traditional alkaline cleaners and enhanced scale control properties even when diluted to about 1/40 ounce per gallon to about 1/10 ounce per gallon in potable water and even in exceptionally hard water. The inventive composition generally maintains its cleaning efficacy and scale control properties during use.

U.S. Pat. No. 8,329,630 relates to cleaner compositions, methods of making cleaners, and methods of use are disclosed. Disclosed is a method of formulating a ready-to-use degreaser composition that supposedly has extended cling time. The method of making the cleaner results in thickened compositions that are capable of removing from vertical and inverted surfaces fresh, greasy and baked-on soils encountered in the food industry. The compositions include one or more alkalinity sources, one or more chelants, one or more surfactants, one or more thickening agents, one or more solvents, one or more buffers, and as a remainder, water. Compositions prepared according to the method of the invention supposedly are substantially free of phosphorous and have a low caustic content making them user friendly, having a lower pH than commercially available cleaners.

CN105754745 relates to a total-effect clothing pre-washing agent free from an organic solvent. The organic solvent has different degrees of toxic actions to the human body, is combustible and easy to explode, pollutes the environment and has obvious limitation. The total-effect clothing pre-washing agent disclosed by the invention is prepared from an anionic surfactant, a nonionic surfactant, an emulsifier with an HLB value of 5-13, aids, a short chain surfactant, a pH value regulator, a hydrotropic agent, a preservative, essence and water, wherein the emulsifier with the HLB value of 5-13 replaces a common organic solvent and is scientifically compatible with detergents and other aids. Oily dirt is removed in emulsifying and dispersing modes. The ratio of the emulsifier to the detergent is between 1:10 and 2:1, an effect of removing multiple stains is supposedly achieved, and the stain removal ratios of standard carbon black stained cloth, protein stained cloth and sebum stained cloth are all over 1.0.

SUMMARY OF THE INVENTION

The present invention relates to a high foaming liquid alkaline cleaner concentrated composition that has an adequate and stable amount of foam, has adequate solubility in water, and prevents redeposition of soils. When applied to a surface in the form of a spray, the cleaner produces a visible foam that has good volume, has good cling to vertical surfaces along with a slow cascade of the foam, is not watery, and reduces or eliminates soil deposits. It also has an excellent cleaning profile even at low use concentrations.

The liquid alkaline cleaning composition of the present invention has been formulated to not contain undesirable compounds such as those that do not meet various state or country environmental regulations such as are contained in the REACH annex XVII restricted substances list, and suspected carcinogens such as those listed in California Proposition 65. Thus, the compounds that have undesirable environmental, or medical, properties that can adversely affect the environment, human beings, or animals are excluded from the present invention. Such compounds include nonylphenol ethoxylate (NPE), cocamide DEA and ethylenediamine tetraacetic acid (EDTA).

Accordingly, the high foaming liquid alkaline cleaner concentrate of the present invention comprises: one or more alkalinity sources including an alkaline compound; one or more hydrotrope surfactants; one or more wetting and soil emulsification surfactants; one or more foam volume generating surfactants; one or more foam boosting surfactants; and one or more sequestrants, and water; said concentration having a pH of from about 10 to about 14.

BRIEF DESCRIPTION OF THE DRAWINGS

The invention will be better understood, and other features and advantages will become apparent by reading the detailed description of the invention, taken together with the drawings, wherein.

DETAILED DESCRIPTION OF THE INVENTION

Figure 1:
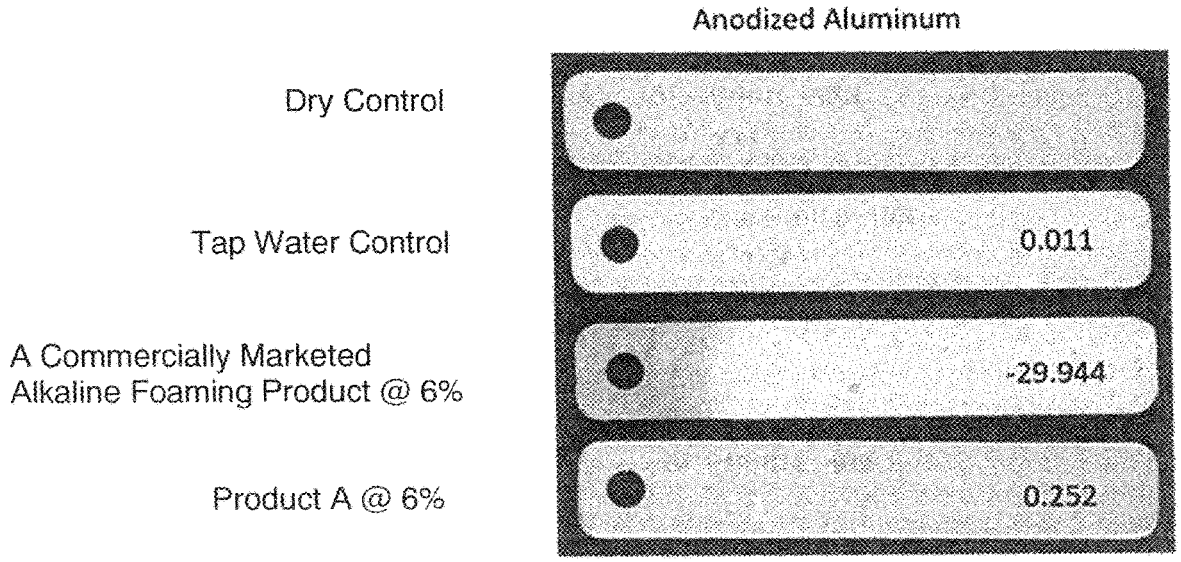
FIG. 1 relates to compatibility testing of the present invention at its highest recommended use dilution and corresponding controls against anodized aluminum. The image shows the visual impact of each solution as well as the calculated mpy (thousandths of an inch lost per year) established for each solution.

The high foaming liquid alkaline cleaner concentration composition of the present invention generally relates to use on non-porous surfaces. Such alkaline cleaners are typically used in the Life Sciences market on non-product contact surfaces such as the exteriors of processing equipment used to produce pharmaceuticals and cosmetics. The composition is intended to be dispensed from a pressurized sprayer at 1-6% volume by volume use dilutions in water. The composition shows excellent foaming characteristics even at the low end of the use dilution range and across a range of water quality (Tap water, Soft water, and DI water). The composition is a good cleaner that is particularly effective against fats, oils, and organic soils with excellent soil emulsifying and dispersing properties. (Soils tested include: Turns, Turmeric, Fish oil, and Sunscreen.) Although it is an alkaline formulation, it exhibits excellent compatibility even with Aluminum and Anodized Aluminum.

The composition is generally a finely tuned system of many compounds generally comprising an alkalinity source, a plurality of surfactants that generally provide favorable specific properties to the cleaner, a sequestrant system comprising a chelant, a corrosion inhibitor, optionally a scale inhibitor, and optionally an organic solvent. The alkaline cleaner is formulated so that it does not adversely affect various metals such as steel, iron, aluminum, such as with respect to corrosion. Another attribute of the present invention is that it is free of various compounds which are suspected carcinogens, toxic compounds, compounds that have a poor biodegradability profile, and the like.

Suitable alkaline sources include sodium hydroxide, sodium bicarbonate, calcium carbonate ammonia hydroxide, monethanolamine, monoisopropanolamine, 2-amino-2-methyl-1-propanol, and 2-amino-2-methyl-1,3-propanediol, with potassium hydroxide being preferred.

The pH of the alkaline cleaner concentrate is generally from about 10 to about 14, desirably from about 11 to about 14, and preferably from about 12 to about 13.5.

In order to provide the indicated pH range, an effective active amount of the one or more alkaline compounds is generally from about 1.3 to about 15 wt. %, desirably from about 2 to about 12 wt. %, and preferably from about 3 to about 9 wt. % based upon 100 wt. %, of the total weight of the high foaming liquid alkaline cleaner concentrate composition. The weight percent of the various compounds utilized throughout the present invention is the weight per se of the active compound that constitutes the formulation item of the present invention as set forth in Table 1. That is, it is only the amount of the "active" material that is part of the compound and not any other ingredient that serves to solubilized, dissolve, etc., the active compound per se. For example, potassium hydroxide is generally available having an active content of about 46 wt. %. Thus, if 10 wt. % of the alkaline cleaning concentrate is potassium hydroxide, the amount of the active potassium hydroxide, per se, is 4.6 wt. % based upon the total weight of the high foaming liquid alkaline cleaning concentrate of the present invention. The remaining (ingredient) weight percent is generally water, or a solvent, or other non-active component.

The surfactant system comprises various surfactants that allow the various components of the cleaning formulation to stay in solution and have desirable cling properties to vertical surfaces and do not precipitate.

One or more hydrotrope surfactants are utilized to improve the physical stability of the concentrated product. Examples thereof include octyldimethylamine oxide, polyoxyethylene phenol ether, alkyl glucoside wherein said alkyl has from about 8 to about 14 carbon atoms, with sodium xylene sulfonate being preferred. Suitable per se amounts of the one or more hydrotropes generally range from about 1 to about 9 wt. %, desirably from about 2 to about 7 wt. %, and preferably from about 3 to about 6 wt. % based on the total weight of the liquid alkaline cleaning concentrate composition, i.e. 100 wt. %.

A wetting and/or soil emulsification surfactant of the present invention comprises a Pareth compound wherein the number of carbon atoms in the fatty alcohol ranges from about 4 to about 18, and desirably from about 6 to about 12 and the number of moles of ethylene oxide is from about 8 to about 11 with about 8 being preferred. A specific example of the same is $C_9$-$C_{11}$ Pareth-8 and the same is available from various sources including Air Products Chemicals, Inc. of Allentown, Pa. as Tomadol 91-8, or from Kolb as Imbentin C/91/080. Such compounds are important since they provide wetting of soils and surfaces, as well as soil emulsification. In lieu of various primary alcohol ethoxylates, secondary alcohol ethoxylates can be utilized that have varying moles of alkoxylation, such as ethoxylation therein having from about 2 to about 15 moles, and desirably from about 3 to about 12 moles. It is preferred that both hydrophilic and hydrophobic compounds are used in combination. Examples of suitable alcohol alkoxylated surfactants include a secondary alcohol ethoxylate having 3 moles of ethoxylation; a secondary alcohol ethoxylate having 5 moles of ethoxylation, a secondary alcohol ethoxylate having 7 moles of ethoxylation, or alkoxylated surfactants having ethylene oxide/proproxylene oxide copolymer, a $C_9$-11 alcohol ethoxylate having 2.5 moles of ethoxylation, a $C_{11}$ alcohol ethoxylate having 3 moles of ethoxylation, an alcohol ethoxylate having 8 moles of ethoxylation, an alcohol ethoxylate having 5 moles of ethoxylation, a $C_9$-11 alcohol ethoxylate having 4 moles of ethoxylation, a $C_8$ alcohol ethoxylate having 4 moles of ethoxylation, a $C_9$-11 alcohol ethoxylate having 2.5 moles of ethoxylation, and a $C_9$-11 alcohol ethoxylate having 5 moles of ethoxylation. Typical examples of commercial surfactants include: Tergitol 15-S-3, Tergitol 15-S-5, Tergitol 15-S-7, Tergitol 15-S-9, Tergitol L-62, Tergitol L-61, Tomadol 900, Tomadol 91-8, Tomadol 91-2.5, Tomadol 1-3, Berol 260, Berol 508, Berol 505, Berol 609, Berol 840, Neodol 91-2.5, Neodol 91-5, Neodol 1-2.5, and Neodol 1-5. Tomadols are commercially available from Tomah Products Inc., Tergitols are commercially available from Dow, Berols are commercially available from Akzo Nobel, and Neodols are commercially available from Shell Chemical Company.

The total amount of the one or more Pareth compounds and the one or more alcohol alkoxylated nonionic surfactants is generally from about 0.1 wt. % to 10 wt. %, desirably from about 0.5 wt. % to 5 wt. %, and preferably from about 0.8 wt. % to about 3 wt. %, based upon the total weight of all set forth components of the high foaming liquid alkaline cleaner concentrate of the present invention.

Aromatic alcohol ethoxylates such as various phenol ethoxylates, e.g. nonylphenol ethoxylate, are avoided since they are suspected toxins. Thus, the high foaming liquid alkaline cleaner concentrates of the present invention are free of such aromatic ethoxylates. That is, if any aromatic ethoxylates are utilized, they are utilized in very small amounts such as less than about 1% by weight or less, desirably less than about 0.5% by weight, and desirably nill, that is no amount whatsoever is utilized based on the total weight of the liquid alkaline cleaning concentrate composition, i.e. 100 wt. %.

An important property of the cleaner concentrate compositions of the present invention is that they provide suitable foam volume. They are dispensed as a use dilution from pressurized sprayers. The product is applied as a foam on the surface that needs to be cleaned. The foamed product then cascades down the surface taking the soil with it. The product must have sufficient foam that lasts a sufficient amount of time to give it the needed cling profile on a vertical surface to allow the product to work against the soil before running off the surface.

Examples of suitable foam volume generating surfactants are generally various sodium olefin sulfonates such as a sodium salt having an alkyl group of from about 10 to about 20 carbon atoms with from about $C_{14}$-$C_{16}$ carbon atoms being preferred. Other foam volume generating surfactants include sodium lauryl sulfate, sodium lauryl ether sulfate, lauramine oxide, neutralized dodecylbenzene sulfonic acid (sodium or potassium salts). General amounts of the foam volume generating surfactant is from about 2 to about 10 wt. %, desirably from about 3 to about 9 wt. %, and preferably from about 4 to about 8 wt. %, based upon the total weight of the liquid alkaline cleaner concentrate, i.e. 100 wt. %.

A foam boosting surfactant that is utilized is a cocamide that boosts the foam profile as well as gives the foam a drier nature that allows a slower removal or cascade from a vertical surface. A "cocamide" is an alkanolamide. An alkanolamide is the reaction product of an alkanolamide containing from about 2 to about 6 alcohol carbon atoms such as monoethanolamine (MEA), Monisopropanolamine (MIPA) or diisopropanolamine (DIPA) and a fatty material such as triglyceride acid, or methyl ester. Their general structures can be represented as: R—C(O)—NH—$CH_2CH_2OH$ (cocamide MEA). However, Cocamide DEA is a suspected carcinogen and hence is not utilized in the present invention. That is, any use thereof is very small, such as about 1 wt. % or less, desirably about 0.5 wt. % or less, and preferably nil, that is no amount whatsoever is utilized based upon the total weight of the liquid alkaline cleaning concentrate composition of the present invention, i.e. 100 wt. %. The amount of the one or more cocamides is generally from about 2 to about 10 wt. %, desirably from about 3 to about 10 wt. %, and preferably from about 6 to about 9 wt. %, based upon the total weight of the liquid alkaline cleaner concentrate composition, i.e. 100 wt. % with cocamide DIPA being preferred.

The sequestrant system of the present invention is a chelant that serves to control hard water allowing the product to foam better and prevent the formation of scale on surfaces. The chelant is utilized to complex polyvalent metal ions generally found in hard water such as magnesium and calcium that negatively impacts the foam profile. By controlling common hard water ions the product foams preform as designed or required even when diluted in hard water. Examples of suitable chelants include tetrasodium glutamate, tetrasodium iminodisuccinate, and sodium polyapartate with MGDA, i.e. methyl glycine diacetic acid, being preferred. Chelants that are avoided since they yield poor properties such as a biodegradable profile include ethylenediamine tetraacetic acid (EDTA), tetrasodium (EDTA) and Nitrilotriacetic acid (NTA). That is, any amount used thereof is very small, that is about 1.0 wt. % or less, desirably 0.5 wt. % or less, and preferably none, that is no compound whatsoever is utilized based upon the total weight of the liquid alkaline cleaner concentrate composition, i.e. 100 wt. %. The active amount of the one or more chelants is generally from about 0.2 to about 4 wt. %, desirably from about 0.4 to about 3 wt. %, and preferably from about 0.8 to about 2 wt. %, based upon the total weight of the liquid alkaline cleaner concentrate composition, i.e. 100 wt. %.

Corrosion inhibitors are utilized to, of course, prevent corrosion that might be caused by the high foaming liquid alkaline cleaner concentrate of the present invention to various substrates. Suitable one or more corrosion inhibitors include phosphonobutane tricarboxylic acid, sodium tolytriazole, sodium benzotriazole, and polycarboxylic acid with potassium silicate being preferred.

The total active amount of the one or more suitable corrosion inhibitors is from about 1.0 to about 9 wt. %, desirably from about 3 to about 8 wt. %, and preferably from about 3.5 to about 6 wt. % based upon the total weight of the alkaline cleaning concentrate composition of the present invention. Potassium silicate is 29% active.

A scale inhibitor is also utilized for improving the anti-redeposition properties of the liquid alkaline cleaning concentrate composition. Suitable one or more scale inhibitors include tetrasodium glutamate, aminotrimethylene phosphonic acid, and carboxymethyl inulin, and with sodium polyacrylate being preferred as it additionally stabilizes the foam. Such polymers have a weight average of from about 3,000 to about 8,000 with a weight average mole weight of about 4,000 to about 5,500 being preferred. Sources of sodium polyacrylate include Rohm and Haas under the tradename Acusol 445ND which has a weight average molecular weight of about 4,500 and AkzoNobel under the tradename Alcosperse 602N that has a weight average molecular weight of about 5,000. The amount of the scale inhibitor is generally from about 0.5 to about 8 wt. %, desirably from about 1 to about 6 wt. %, and preferably from about 1 to about 2.5 wt. %, based upon the total amount of the liquid alkaline cleaning concentrate of the present invention, i.e. 100 wt. %.

Organic solvents such as PPG-2 methyl ether, dipropylene glycol ether, propylene glycol n-propyl ether and propylene glycol n-butyl ether are utilized to remove soils that are not readily soluble in water. The amount thereof is generally from about 1 to about 8 wt. %, desirably from about 2 to about 6 wt. %, and preferably from about 2 to about 5 wt. % based upon the total weight of the liquid alkaline cleaner concentrate composition.

The amount of water in the concentrate formulation can generally range from about 35 to about 80 wt. % and preferably from about 40 to about 55 wt. % based upon the total weight of the liquid alkaline cleaner concentrate composition. Such concentrate is typically diluted 1-6% v/v but can be diluted at higher concentrations, up to 12 v/v, where extreme soil load is present.

EXAMPLES

Various aluminum coupons were tested with regard to a high foaming liquid alkaline cleaner concentrate of the present invention. The formulation of the proposed product A of the present invention is as set forth in Table 1.

TABLE 1

Formulation Comparison
Formula Weight %

| Material Name | Proposed Product A (wt. %) |
|---|---|
| Soft Water (100%)[active %] | 41.5000 |
| Potassium Silicate (29.1%) | 16.0000 |
| Potassium Hydroxide (46%) | 10.0000 |
| Methyl Glycine Diacetic Acid (40%) | 3.0000 |
| Sodium Polyacrylate (94%) | 2.5000 |
| Sodium Xylene Sulfonate (45%) | 10.0000 |
| Sodium $C_{14}$-$C_{16}$ Olefin Sulfonate | 6.0000 |
| Cocamide DIPA | 7.0000 |
| $C_{9-11}$ Pareth-8 | 1.0000 |
| PPG-2 Methyl Ether | 3.0000 |

The proposed liquid alkaline cleaning concentrate of the present invention was prepared as follows: A majority of the water is charged to the mixing vessel and moderate agitation initiated. The potassium silicate is added followed by the potassium hydroxide. The vessel is allowed to mix until materials are incorporated typically less than 5 min. Next, the methyl glycine diacetic acid, sodium xylene sulfonate, and sodium polyacrylate are added (in the stated order). Approximately 10 min of mixing is allowed for the sodium polyacrylate to go into solution. Finally, the sodium $C_{14}$-$C_{16}$ olefin sulfonate, cocamide DIPA, $C_{9-11}$ Pareth 8 and PPG-2 methyl ether are added in the stated order, followed by 15-20 minutes of mixing to ensure the final concentrate is homogeneous.

Compatibility testing was conducted under static immersion in the highest recommended use dilution at room temperature for a total of 168 hours. Upon completion of the testing, the coupons were rinsed with DI water and allowed to dry. The impact on the coupons was determined gravimetrically, with each coupon weighed and the mpy (thousandths of an inch lost per year) calculated based on the change in weight.

The cleaning testing was conducted on preweighed coupons coated with a known amount of Turns, fish Oil, and turmeric soils. The coupons were mounted on a vertical surface and sprayed with the above noted diluted products dispensed from a pressurized sprayer. Each coupon was sprayed for three cycles of a 15 second spray with a 15 second hold period for a total of 45 seconds of spraying to apply the foaming product. After the third cycle the coupons were observed for foam appearance before being dipped in Deionized water to rinse remaining foam product. The coupons were then observed for visual cleanliness and were measure gravimetrically so the percent removal achieved by each product could be calculated.

Foam profile testing was conducted by dispensing the present invention on to a vertical surface from a pressurized sprayer at the lowest recommended use dilution. At the conclusion of the test, the surface was examined. The currently marketed foam product showed no visible foam thereon. The resulting spray was very watery and quickly cascaded off the vertical surface in under 30 second. In contrast thereto, a visible foam with excellent foam volume and stability was produced by the proposed formulation A of the present invention. The foam clung to the vertical surface with a slow cascade that was observed for over 3 minutes and still had foam remaining on the surface.

Figure 2:
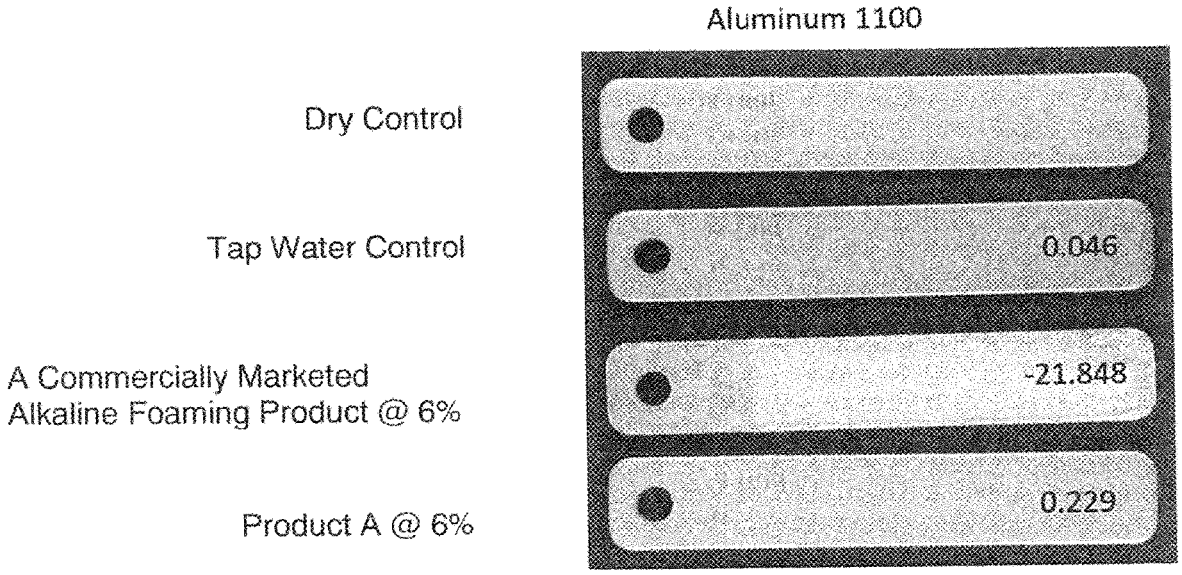
FIG. 2 relates to compatibility testing of the present invention at its highest recommended use dilution and corresponding controls against aluminum 1100. The image shows the visual impact of each solution as well as the calculated mpy (thousandths of an inch lost per year) established for each solution.
Figure 3:
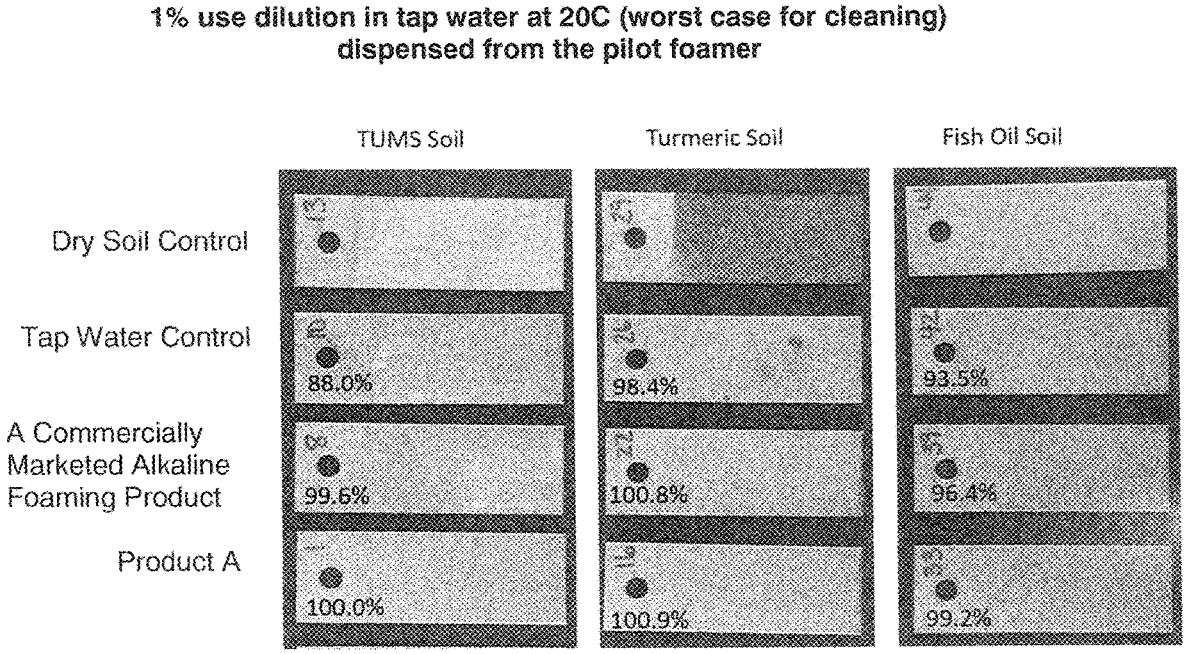
FIG. 3 relates to cleaning data with regard to various alkaline cleaning formulations of the present invention with respect to stainless steel coupons soiled with Tums, fish oil, and turmeric soils and subsequently treated with various cleaning compositions dispensed from a pressurized sprayer.

The results are also set forth in FIGS. 1,2, and 3 herein. FIG. 1 shows the result of compatibility testing with the present invention at its highest recommended use dilution against Anodized Aluminum. The corresponding controls are also shown. The values on the substrates are the mpys (thousandths of an inch lost per year) after exposure to the solutions. FIG. 2 shows the same for Aluminum 1100. FIG. 3 shows the cleaning achieved by the present invention with that achieved by the corresponding controls against Tums, turmeric, and fish oil soils. The percent shown on each coupon is the calculated percent removal of the soil.

While in accordance with the Patent Statutes, the best mode and preferred embodiments have been set forth, the scope of the invention is not limited thereto, but rather, by the scope of the attached claims.

What is claimed is:

1. A high foaming liquid alkaline cleaner concentrate, comprising:

A) from about 1.3 wt. % to about 15 wt. % of one or more alkalinity sources comprising an alkaline material, wherein said alkaline material is selected from the group consisting of sodium hydroxide, potassium hydroxide, sodium bicarbonate, calcium carbonate, ammonium hydroxide, monethanolamine, monoisopropanolamine, 2-amino-2-methyl-1-propanol, or 2-amino-2-methyl-1,3-propanediol;

B) from about 1 wt. % to about 9 wt. % of one or more hydrotrope surfactants, wherein said hydrotrope is selected from the group consisting of octyldimethylamine oxide, polyoxyethylene phenol ether, alkyl glycoside wherein said alkyl group has from about 8 to about 14 carbon atoms, or sodium xylene sulfonate;

C) from about 0.1 wt. % to about 10 wt. % of one or more wetting and soil emulsification surfactants, wherein said wetting surfactant comprises one or more Pareth compounds, wherein the number of carbon atoms in the fatty alcohol portion is from about 4 to about 18 and wherein the number of moles of ethylene oxide is from about 8 to about 11, or one or more primary alcohol ethoxylates or one or more secondary alcohol ethoxylates wherein the number of moles of said ethoxylate is from about 2 to about 15;

D) from about 2 wt. % to about 10 wt. % of one or more foam volume generating surfactants, wherein said foam volume generating surfactant comprises one or more sodium olefin sulfonates wherein said olefin has from about 10 to about 20 carbon atoms;

E) from about 2 wt. % to about 10 wt. % of one or more foam boosting surfactants, wherein said foam boosting surfactant comprises one or more cocamides;

F) from about 0.2 wt. % to about 4 wt. % of one or more sequestrants, wherein said sequestrant is one or more chelants, wherein said chelants are selected from the group consisting of tetrasodium iminodisuccinate, tetrasodium glutamate, sodium polyasparate, or methyl glycine diacetic acid (MGDA);

G) from about 1 wt. % to about 9 wt. % of one or more corrosion inhibitors, wherein said corrosion inhibitors are selected from the group consisting of phosphonobutane tricarboxylic acid, sodium tolytriazole, sodium benzotriazole, a polycarboxylic acid, or potassium silicate;

H) from about 0.5 wt. % to about 8 wt. % of one or more scale inhibitors, wherein said scale inhibitor is selected from the group consisting of tetrasodium glutamate, aminotrimethylene phosphonic acid, carboxymethyl inulin, or sodium polyacrylate;

I) from about 1 wt. % to about 8 wt. % of one or more organic solvents selected from the group consisting of PPG-2 methyl ether, dipropylene glycol ether, propylene glycol n-propyl ether, or propylene glycol n-butyl ether; and J) water; wherein said concentrate has a pH of from about 10 to about 14, and wherein all weight percents are based upon 100 wt. % of said foaming liquid alkaline cleaning concentrate.

2. The high foaming liquid alkaline cleaning concentrate of claim 1, wherein the amount of said alkaline compounds is from about 2 wt. % to about 12 wt. %; wherein the amount of said hydrotropes is from about 2 wt. % to about 7 wt. %; wherein said foam volume generating surfactant further comprises one or more of sodium lauryl sulfate, sodium lauryl ether sulfate, lauramine oxide, or neutralized dodecylbenzene sulfonic acid (sodium or potassium salts); wherein the amount of said cocamides is from about 3 wt. % to about 10 wt. %; wherein the amount of said chelants is from about 0.4 wt. % to about 3 wt. %; wherein the amount of said corrosion inhibitors is from about 3 wt. % to about 8 wt. %; wherein the amount of said scale inhibitor is from about 1 wt. % to about 6 wt. %; wherein the amount of said organic solvents is from about 2 wt. % to about 6 wt. %; and wherein the pH of said concentrate is from about 11 to about 14.

3. The high foaming liquid alkaline cleaning concentrate of claim 2, wherein the amount of the wetting surfactants is from 0.8 wt. % to about 3 wt. %; wherein said corrosion inhibitors comprise potassium silicate; wherein the said scale inhibitor is said sodium polyacrylate wherein said sodium polyacrylate has a weight average molecular weight of from about 3,000 to about 8,000; and wherein the amount of said organic solvents is from about 2 wt. % to about 6 wt. %.

4. The high foaming liquid alkaline cleaning concentrate of claim 3, wherein said alkaline compound comprises said potassium hydroxide, and wherein said amount of alkaline compounds ranges from about 3 wt. % to about 9 wt. %; wherein said hydrotropes comprises sodium xylene sulfonate and wherein the amount thereof is from about 3 wt. % to about 6 wt. %; wherein the amount of said foam volume generating surfactants is from about 3 wt. % to about 9 wt. %, wherein the number of carbon atoms in said olefin group is from about 14 to about 16 carbon atoms; wherein said cocamides comprises Cocamide MEA or Cocamide DIPA; wherein said chelant is MGDA and the amount of said chelant is from about 0.8 wt. % to about 2 wt. %; wherein the amount of said corrosion inhibitors is from about 3.5 wt. % to about 6 wt. %; wherein the amount of said sodium polyacrylate is from about 1 wt. % to about 2.5 wt. % and wherein said sodium polyacrylate has a weight average molecular weight of from about 4,000 to about 5,500; the amount of said organic solvents is from about 2 wt. % to about 5 wt. % and wherein said inorganic solvent comprises PPG-2 methyl ether, wherein the pH of said concentrate is from about 12 to about 13.5, and wherein the amount of said water is from about 35 wt. % to about 80 wt. % based upon the total weight of said liquid alkaline cleaner concentrate composition.

5. The high foaming liquid alkaline cleaning concentrate of claim 4, wherein said wetting and soil emulsification surfactants is $C_{9-11}$ Pareth-8; wherein the amount of said foam volume generating surfactants is from about 4 wt. % to about 8 wt. %; and wherein the amount of said cocamides is from about 6 wt. % to about 9 wt.

6. The high foaming liquid alkaline cleaning concentrate of claim 1, wherein any amount of EDTA or tetrasodium EDTA, or Nitrilotriacetic acid, is about 1 wt. % or less per 100 wt. % of said high foaming liquid alkaline cleaning concentrate, wherein any amount of Cocamide DEA is about 1 wt. % or less per 100 wt. % of said high foaming liquid alkaline cleaning concentrate, and wherein any amount of an aromatic ethoxylate is 1 wt. % or less per 100 wt. % of said high foaming liquid alkaline cleaning concentrate.

7. The high foaming liquid alkaline cleaning concentrate of claim 4, wherein any amount of EDTA or tetrasodium EDTA, or Nitrilotriacetic acid, is nil per 100 wt % of said high foaming liquid alkaline cleaning concentrate, wherein any amount of Cocamide DEA is nil per 100 wt. % of said high foaming liquid alkaline cleaning concentrate, and wherein any amount of an aromatic ethoxylate is nil per 100 wt % of said high foaming liquid alkaline cleaning concentrate.

8. A high foaming liquid alkaline cleaner concentrate, comprising:

A) an effective amount of a potassium hydroxide alkaline source so that said concentrate has a pH of from about 10 to about 14;

B) one or more hydrotrope surfactants, wherein said hydrotrope is sodium xylene sulfonate;

C) one or more wetting and soil emulsification surfactants, wherein said wetting surfactant comprises $C_{9-11}$ Pareth-8;

D) one or more foam volume generating surfactants, wherein said foam volume generating surfactant is sodium olefin sulfonate, wherein said olefin has from about 14 to about 16 carbon atoms;

E) one or more loam boosting surfactants, wherein said foam boosting surfactant comprises Cocamide MEA or Cocamide DIPA;

F) one or more chelants, wherein said chelant is methyl glycine diacetic acid (MGDA);

G) one or more corrosion inhibitors, wherein said corrosion inhibitor is potassium silicate;

H) one or more scale inhibitors, wherein said scale inhibitor is sodium polyacrylate; and I) PPG-2 methyl ether organic solvent.

9. A high foaming liquid alkaline cleaner concentrate, comprising:

A) from about 1.3 wt. % to about 15 wt. % of one or more alkalinity sources comprising an alkaline material, wherein said alkaline material is selected from the group consisting of sodium hydroxide, potassium hydroxide, sodium bicarbonate, calcium carbonate, ammonium hydroxide, monethanolamine, monoisopropanolamine, 2-amino-2-methyl-1-propanol, or 2-amino-2-methyl-1,3-propanediol;

B) from about 1 wt. % to about 9 wt. % of one or more hydrotrope surfactants, wherein said hydrotrope is selected from the group consisting of octyldimethylamine oxide, polyoxyethylene phenol ether, alkyl glycoside wherein said alkyl group has from about 8 to about 14 carbon atoms, or sodium xylene sulfonate;

C) from about 0.1 wt. % to about 10 wt. % of one or more wetting and soil emulsification surfactants, wherein said wetting surfactant comprises one or more Pareth compounds, wherein the number of carbon atoms in the fatty alcohol portion is from about 4 to about 18 and wherein the number of moles of ethylene oxide is from about 8 to about 11, or one or more primary alcohol ethoxylates or one or more secondary alcohol ethoxylates wherein the number of moles of said ethoxylate is from about 2 to about 15;

D) from about 2 wt. % to about 10 wt. % of one or more foam volume generating surfactants, wherein said foam volume generating surfactant comprises one or more sodium olefin sulfonates wherein said olefin has from about 10 to about 20 carbon atoms;

E) from about 2 wt. % to about 10 wt. % of one or more foam boosting surfactants, wherein said foam boosting surfactant comprises one or more cocamides;

F) from about 0.2 wt. % to about 4 wt. % of one or more sequestrants, wherein said sequestrant is one or more chelants, wherein said chelants are selected from the group consisting of tetrasodium iminodisuccinate, tetrasodium glutamate, sodium polyasparate, or methyl glycine diacetic acid (MGDA);

G) from about 1 wt % to about 9 wt. % of one or more corrosion inhibitors, wherein said corrosion inhibitors are selected from the group consisting of phosphonobutane tricarboxylic acid, sodium tolytriazole, sodium benzotriazole, a polycarboxylic acid, or potassium silicate;

H) from about 0.5 wt. % to about 8 wt. % of one or more scale inhibitors, wherein said scale inhibitor is selected from the group consisting of tetrasodium glutamate, aminotrimethylene phosphonic acid, carboxymethyl inulin, or sodium polyacrylate; and I) from about 1 wt. % to about 8 wt. % of an organic solvent; wherein said concentrate has a pH of from about 10 to about 14, and wherein all weight percents are based upon 100 wt. % of said foaming liquid alkaline cleaning concentrate.

10. The high foaming liquid alkaline cleaning concentrate of claim 8, wherein the amount of said corrosion inhibitors is from about 3.5 wt. % to about 6 wt. %; wherein the amount of said cocamide foam boosting surfactant is from about 6 wt. % to about 9 wt. %; wherein the amount of said foam volume generating surfactant is from about 4 wt. % to about 8 wt. %; wherein the amount of said hydrotrope from about 3 wt. % to about 6 wt. %; wherein the amount of said alkaline compounds ranges from about 3 wt. % to about 9 wt. %; wherein the amount of said chelant is from about 0.8 wt. % to about 2 wt. %; wherein the amount of said wetting and soil emulsification surfactant is from 0.8 wt. % to about 3 wt %; wherein the amount of said scale inhibitor is from about 0.5 wt. % to about 8 wt. % and has a weight average molecular weight of from about 3,000 to about 8,000; wherein the amount of said organic solvent is from about 2 wt. % to about 5 wt. %; and wherein all weight percents are based upon 100 wt. % of said high foaming liquid alkaline cleaner concentrate.

* * * * *